United States Patent [19]

Hürlimann

[11] Patent Number: 4,664,094

[45] Date of Patent: May 12, 1987

[54] APPARATUS FOR THROWING OBJECTS

[76] Inventor: Paul Hürlimann, Zürcherstr. 68a, CH-5400 Baden, Switzerland

[21] Appl. No.: 443,924

[22] Filed: Nov. 23, 1982

[51] Int. Cl.[4] ..... A63B 69/04

[52] U.S. Cl. ..... 124/54; 124/6; 124/82

[58] Field of Search ..... 124/6, 4, 41 R, 36, 124/7, 54, 82

[56] References Cited

U.S. PATENT DOCUMENTS 2,057,599 10/1936 Serrano ..... 124/6 X 3,602,208 8/1971 Huerlimann ..... 124/6

*Primary Examiner*—Paul E. Shapiro

*Attorney, Agent, or Firm*—Burns, Doane, Swecker & Mathis

[57] ABSTRACT

In a training device for sports equipment, especially for serving tennis balls, the balls are supplied from a storage container through a laterally pivotable charging opening to a ball supply device. The ball supply device includes an endless belt circulating vertically over two rollers and the balls are rolled upwards beneath a lower roller and between the endless belt and a side wall of a housing of the ball supply device and roll over an upper roller into a waiting position. From the waiting position the balls arrive in a serving position on curved guide tracks of a supporting and guiding device provided with a ball striker. Between the guide tracks, a rotatable serving device is arranged on a base plate and is connected to a central shaft and a driving device for rotation therewith. The serving device has a serving plate pivotable into the ball serving track. The serving frequency and the flight path of the balls are adjustable through a control device. A gearing system with a free wheel clutch is provided for returning the serving plate into its initial position.

6 Claims, 8 Drawing Figures

APPARATUS FOR THROWING OBJECTS

BACKGROUND AND SUMMARY OF THE PRESENT INVENTION

The present invention relates generally to apparatus for throwing or projecting objects. More particularly, the present invention relates to apparatus for serving tennis balls to a practicing player.

According to my U.S. Pat. No. 3,602,208, the disclosure of which is incorporated herein by reference, a known apparatus for throwing tennis balls, has a driving, controlling and throwing device. Therein, the apparatus for throwing tennis balls can vary the horizontal direction of the thrown balls and the speed of the thrown balls. Briefly, horizontal direction is changed by moving support 9 (FIG. 2) about a shaft 12. The cam 72 is moved by a cam follower 71. Each lobe of the cam 72, when coming into contact with the cam follower 71, causes angular displacement of support 9 and the throwing mechanism. Speed is adjusted by varying the distance between the drive pulley 16 and the pulley 14. The pulley 14 is adjustable through angular level 74 which is moved by a joint 74*a* (FIG. 1), link 76 (FIGS. 1 and 2), and universal joint 76*a* (FIG. 2) connected to cam follower lever 77 (FIG. 1) attached to cam follower 78 of cam 79. A similar arrangement is provided in the present invention for adjusting horizontal direction and speed. A mechanism for releasing the release element 30′ is also disclosed and includes a cam wheel 66 (FIG. 1) with lobe 67 closing a switch 44. The switch 44 (FIGS. 6 and 8) actuates an electromagnet 41 to cause release element 38 to be moved via member 42.

However, with high exit velocities and a more rapid throwing sequence, the tennis balls have a non-uniform trajectory whereby, at the same time, the guiding of the balls into the track of the guide spiral and the closing of the closure member are subjected to interference.

Thus, it has already been proposed to overcome this dificiency so that a jerk-free expulsion of the balls is guaranteed by, on the other hand, an automatic compensation of the throwing device, especially by a compensation of the ball weight during the supply of the balls to the exit opening of the throwing device and on the other hand, by an improved control of the release and closure member.

However, with these known devices, a sufficiently strong and accurate ball delivery is only possible to a limited extent whereby a variation of all possible game procedures is limited.

According to the present invention there is provided an apparatus for throwing or hurling objects. The apparatus has a hurling device including a striker mounted on a rotatable member for movement in a circular path and pivotal into an operative position extending radially outwardly of the member for striking an object supplied to a guide track of the apparatus. The object is thereby projected from the apparatus. Selectively operable means are provided to cause the striker to pivot into the operative position. Means responsive to the rotational movement of the member are provided for pivoting the striker into a nonoperative position subsequent to the striker striking an object.

A preferred embodiment described hereinafter includes an apparatus for serving tennis balls in which each ball, located in the serving position of a supporting and guiding device, is served by a rotating striker or serving plate. Thus, practically any required ball range and height of flight path can be achieved.

A further advantage of the preferred embodiment rests in the fact that the ball located in the serving position is stationary with respect to the rotating serving device whereby a quieter running of the apparatus is facilitated.

A pivotable adjustment plate which is common to a control device, the supporting and guiding device as well as the serving device is also preferably provided. In this way, an accurate vertically and laterally adjustable serving angle (i.e., elevation and azimuth angle), adjustable with reference to the axis of rotation, is guaranteed.

BRIEF DESCRIPTION OF THE DRAWINGS

In order that the invention may be better understood, the preferred embodiment thereof, which is given by way of example only, will now be described with reference to the accompanying drawings, in which like members bear like reference numerals, and in which.

DETAILED DESCRIPTION OF THE PREFERRED EMBODIMENT

Figure 1:
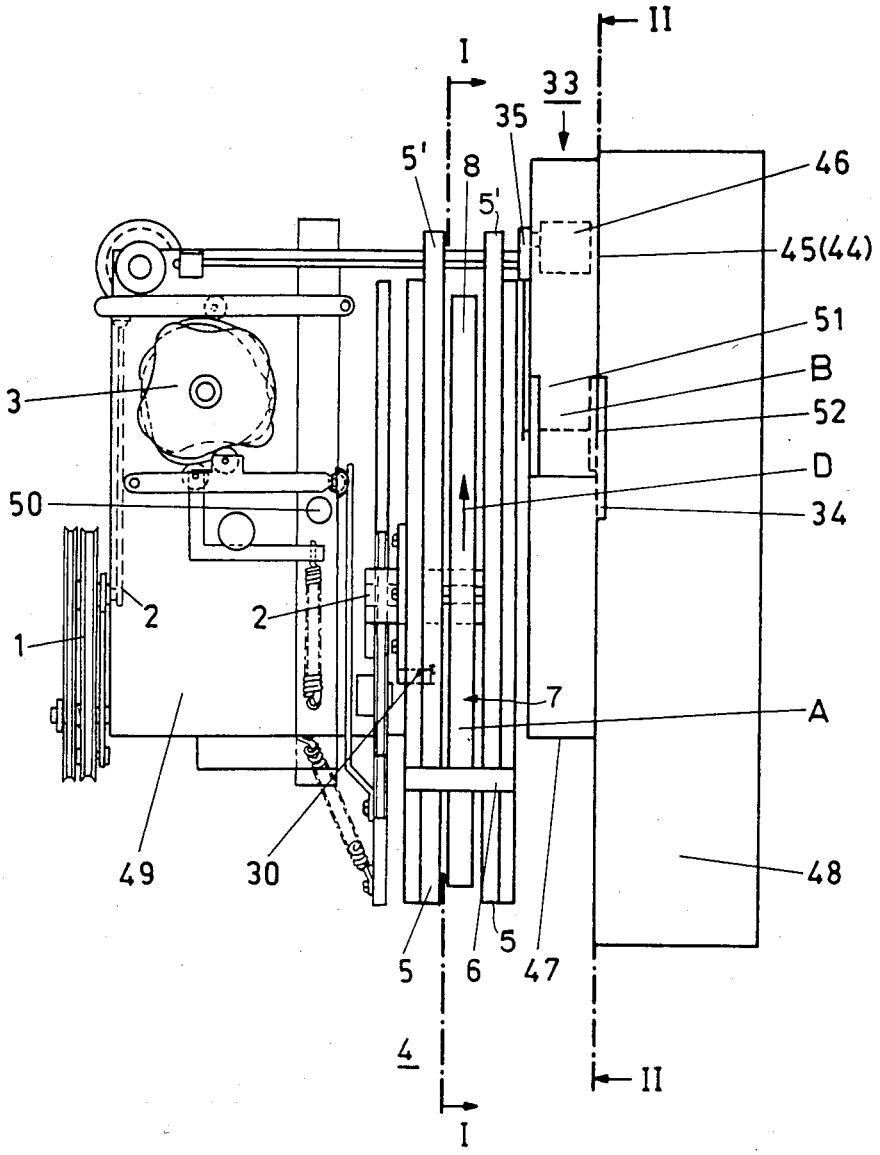
FIG. 1 is a top plan view, in partial section, of the complete arrangement of an apparatus for serving tennis balls.

According to FIG. 1, an apparatus for serving or throwing tennis balls or other objects, includes a driving device 1, known per se, with a control device 3 coupled thereto. A supporting and guiding device 4 and a serving or hurling device 7, rotationally connected to the guiding device 4 are also provided. The serving device 7 is controlled and driven from the driving device 1 and the control device 3 (which may be a cam shaft) by a central shaft 2. These devices are arranged on an adjustment plate 49, provided for adjusting the azimuth, elevation and frequency, pivotable about an axis 50 by the control device 3. The driving device 1, adjustment plate 49 and control device 3 may be of the type disclosed in the above-mentioned U.S. Pat. No. 3,602,208. The supporting and guiding device 4 includes curved guide tracks 5 which are provided in the serving direction with straight discharging guides 5′ at their ends and at the opposite end with an adjustably arranged ball striker 6 (see also FIG. 3). Accordingly, the adjustment plate 49 is a controller for the apparatus with the serving device 7 comprising the plate 8 and striker 25. Of course, the guide tracks 5, 5' are located on both sides of the plate 8.

Figure 4:
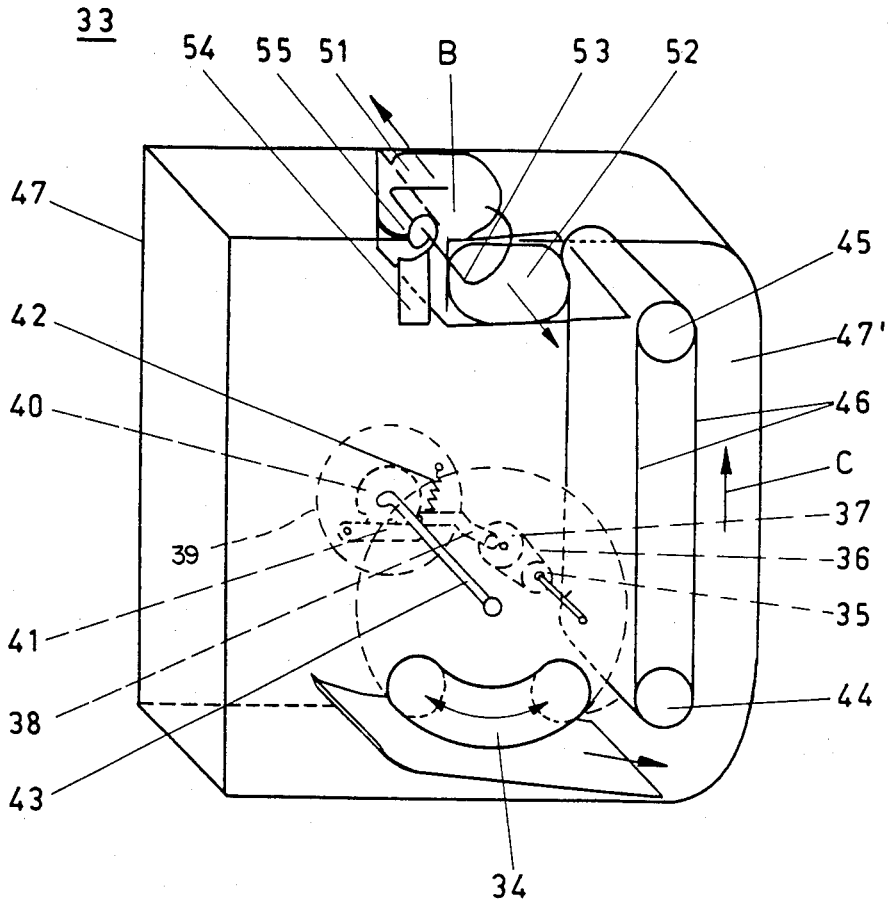
FIG. 4 is a perspective view of a ball supply means of the apparatus along the line II—II in FIG. 1.

With reference now also to FIG. 4, a ball supply device 33 is provided, on the opposite side of the supporting and guiding device 4 and 5 from the driving device 1, whereby the balls (not shown) arrive at a vertical conveyor 44–47' from a storage container 48 through a laterally pivotable charging opening 34.

After release of a supply opening 51, the balls roll individually out of the waiting position B through the guides 5' into a serving position A arranged on the curved guide tracks 5. In the serving position a ball rests on a ball stop means, 6, in which the supplied ball is located in a serving track D.

A release stop 30 arranged on the supporting and guiding device 4 can be brought cyclically adjustably, for example electromagnetically, into the region of a release element 30' (FIG. 2) of the serving device 7 whereby the ball located in the serving position A is served within one rotation of the serving device 7.

For instance, electromagnetic actuation of release element 30' to move latch 28 to the unlatched position may be accomplished in the manner described in the above-mentioned U.S. Pat. No. 3,602,208 in which an electromagnetic actuator cyclically releases a latch.

FIGS. 2, 2*a*, 2*b* and 2*c* show the serving device 7 in which a serving plate 25 on a base plate 8 provided with an adjustable compensating weight 9 and which has a restoring device formed by a transmission 10–15 and a free wheel clutch 16, is held in a latch 28 by a pin 27. By electromagnetically actuating the release stop 30 (FIG. 1) through the control device 3 in the region of the release element 30', the latch 28 which is made movable is unlatched from the pin 27 against the action of the spring 29 and the serving plate 25 is pivoted by the action of the tension spring 31 into the working position 25' in the serving track D shown in dotted lines and immediately thereafter the ball located in the serving position A is served. The abutments 32, 32' consisting of an elastic material, as well as a compensating weight 26 arranged on the end of the serving plate 25, guarantee a good damping of the percussive movements of the serving plate 25.

The serving plate 25 is pivotally mounted on shaft 18 of base plate 8 which is arranged on the control shaft 2 for rotation by the driving device 1 and rotates at set speeds, which if necessary are variable through the control device 3. The rotary movement of the serving device 7 is transmitted through a gear drive fixedly arranged on the base plate 8 and coaxially with respect to the central shaft 2. The gear drive is formed from a V disc 10 through a V belt 11 and a further V disc 12 and furthermore by a gear transmission consisting of a driving gear wheel 13, two intermediate gear wheels 14, 14' and a final gear wheel 15.

Figure 2:
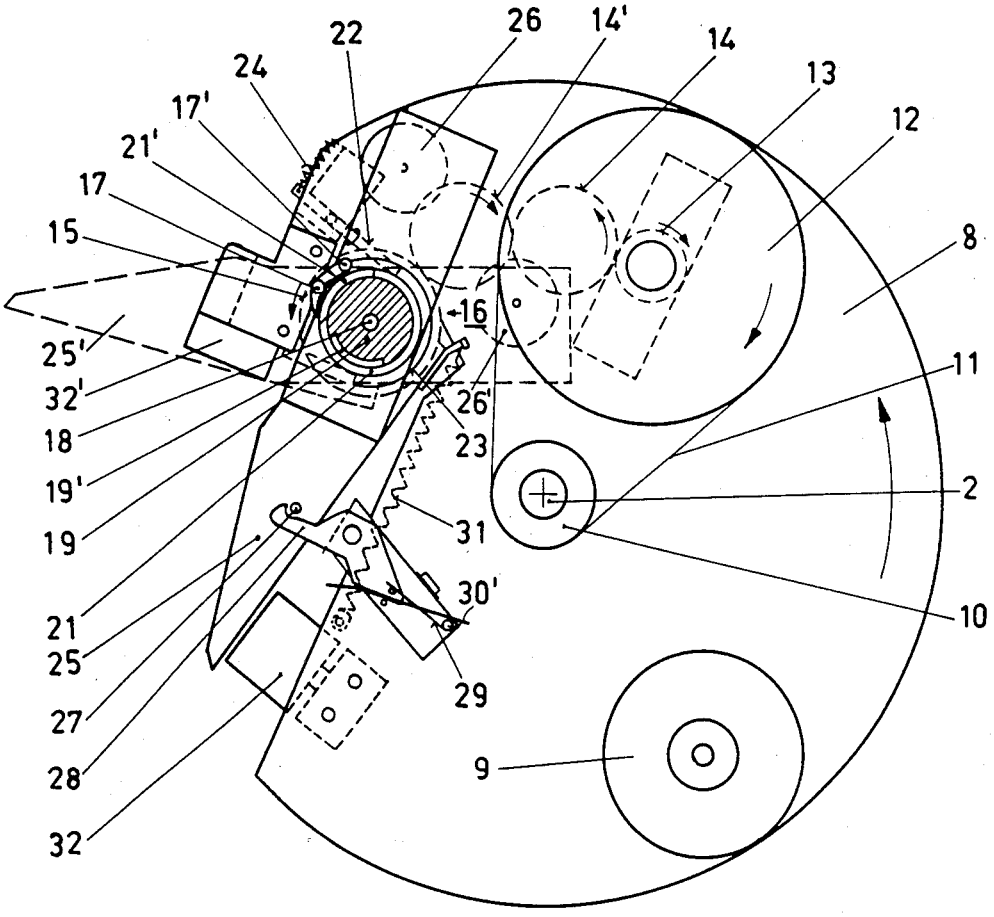
FIG. 2 is a side view of a portion of the apparatus according to FIG. 1, namely the serving device along the line I—I in FIG. 1.
Figure 2A:
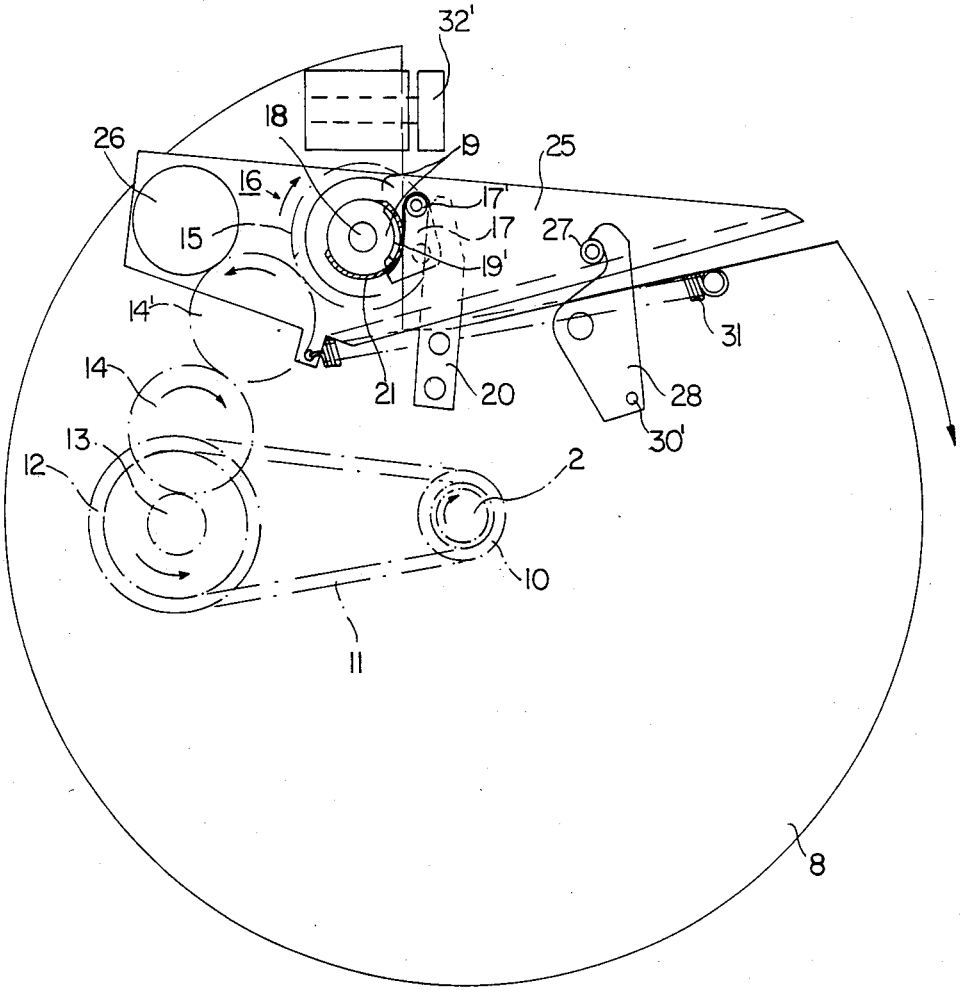
FIG. 2*a* is a back plane view of the serving device within the serving plate in the latched or inoperative position.
Figure 2B:
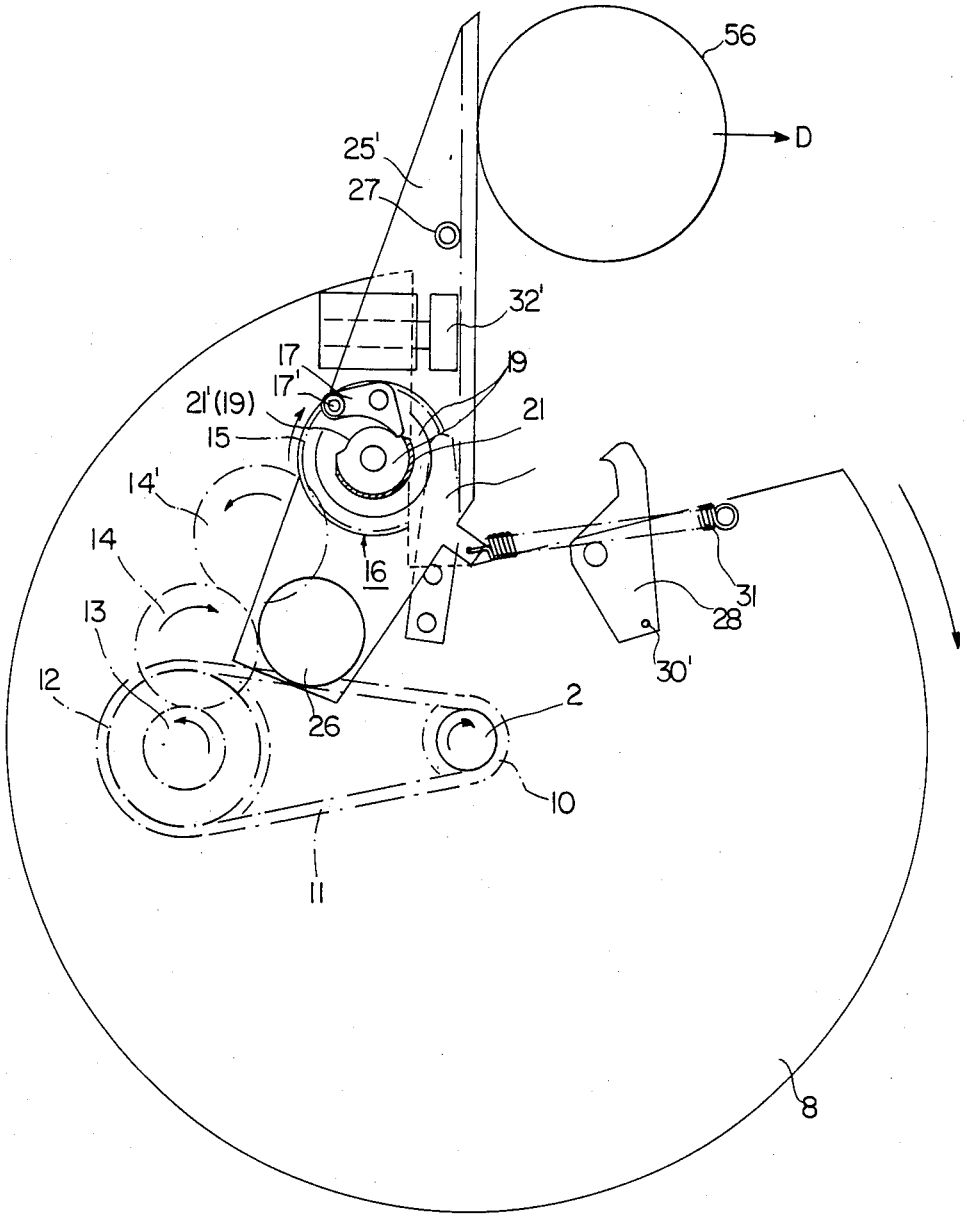
FIG. 2*b* is a view similar to FIG. 2*a*, but with the serving plate in the unlatched operative position.
Figure 2C:
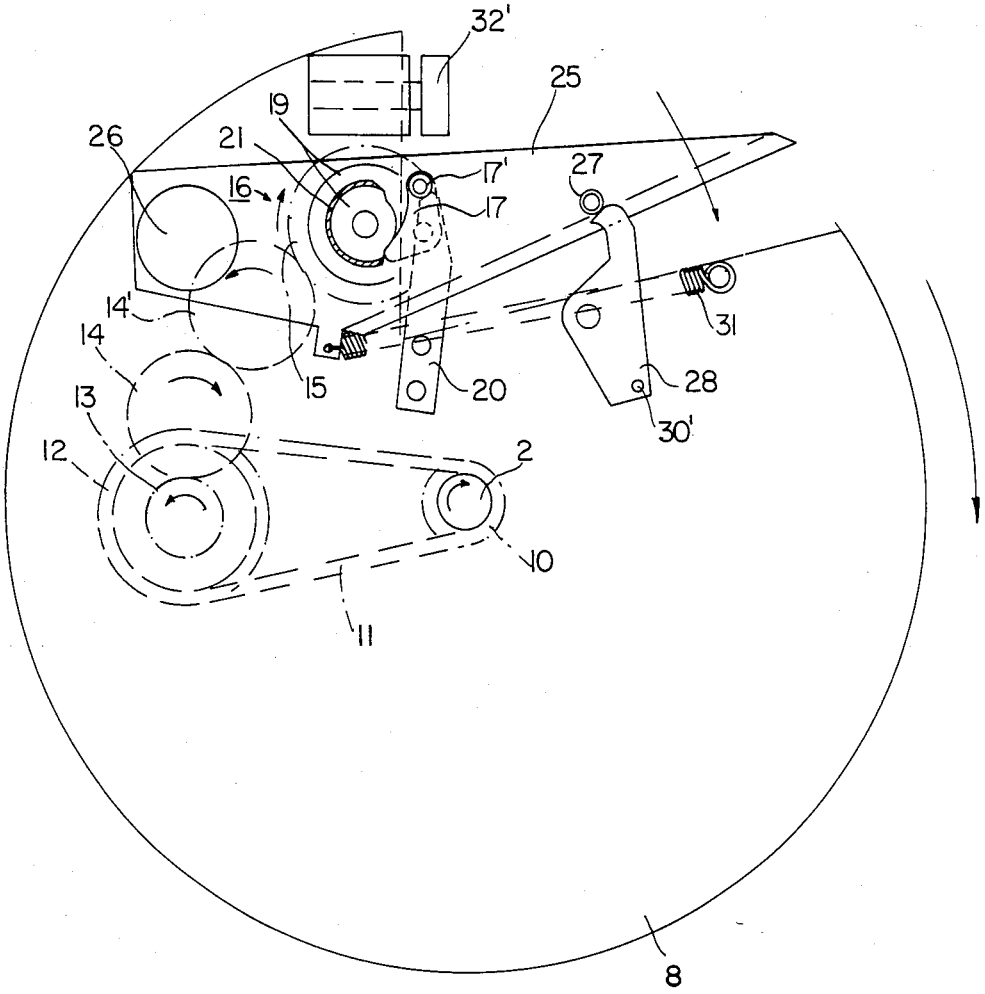
FIG. 2*c* is a view similar to FIGS. 2*a* and 2*b* but with the serving plate in a return position to its latched condition.

The serving plate 25 is mounted on the base plate 8 and is pivotable to a striking position in the manner shown in FIG. 2. Plate 25 is mounted on hub 19 which is attached to a free wheel clutch 16. Further, plate 25 is biased to a striking position by the spring 31 but is restrained by latch 28 which engages pin 27 on the plate 25. The latch 28 is biased to the unlatched position by spring 29 but is restrained by member 30'. Member 30' is moved out of the restraining position by its connection to element 30 controlled by a camming member 3 in a manner fully described in U.S. Pat. No. 3,602,208, the disclosure of which has been incorporated into the specification. When member 30' releases latch 28, the latch 28 is moved out of engagement with pin 27 and striking plate 25 moves into striking position under the influence of spring 31. In so moving, the recess in hub 19 is moved into alignment with the recess in sleeve 21 so as to allow pawl 17, connected to the driven gear 15 to drop into the recesses and provide a drive coupling between gear 15 and hub 19 to which the striker 25 is connected. The gear 15 rotates hub 19 to move striker 25 back into its latched position. The sleeve 21 is also rotated by the gear 15 so as to wind up the spiral spring 23 until pawl 17 is moved out of the recesses by the stripper 20. Removal of pawl 19 allows the tensioned spiral spring 23 to unwind and in so doing rotates sleeve 21 so that the recess of sleeve 21 no longer coincides with the recess in hub 19. Accordingly, when striker 25 is in the striker position and continually rotated by the connection of plate 8 to shaft 2, driven by driving means 1, and when a ball is moved into position A it will be struck by the striker 25.

A pawl 17 is arranged on the final gear wheel 15 at a distance from the gear rim and is in operative association with the free wheel clutch 16. The free wheel clutch 16 and hub 19 are operatively connected to the driven gear 15 when pawl 17 is in the recesses of sleeve 21 and hub 19. The driving connection rotates hub 19 to move the striker 25 into an inoperative position. In a known manner, the pawl 17 is urged against a sleeve 21 which is arranged coaxially with respect to a hub 19 fixed on a shaft 18. Since, a weight 17' acting under centrifugal force is applied at the opposite end of the pawl 17, the pawl 17 is forced against the sleeve 21 of the free wheel clutch 16 and rotated about the sleeve periphery. A spring (not shown) is provided additionally so that the pawl 17 is urged effectively against the sleeve 21 even at low speeds or when stationary. The sleeve 21 and the hub 19 each have a recess 21' and 19', the recesses being displaceable with respect to each other. After the serving plate 25 has been pivoted into the ball serving track D and the ball has been served from its serving position A, the hub 19 with its recess 19' is simultaneously pivoted by the serving plate 25 so that the recess 19' comes to rest beneath the recess 21'. The rotating pawl 17 can then latch in the recesses 21', 19' and within approximately two to three revolutions of the serving device 7, the serving plate 25', which has been pivoted into the serving track D, is pivoted back into its initial position once again whereupon its pin 27 latches in the latch 28. The latch 28 holds striker 25 in a non-operative position and is pivotable so that when the spring 29 releases the latch 28, the tension spring 31 is moved and moves the striker into an operative position by its interconnection therewith. A further recess (not shown) is likewise provided at the opposite, lower, invisible end of the sleeve 21 and in which a locking element 22 can latch which acts as a lever. The end of the locking element 22 facing the sleeve 21 is retained by a spiral spring 23 and can be introduced into the further recess in the sleeve 21 against the action of the spring 24 and thus leads to the locking of the sleeve 21.

The spiral spring 23 is fixed on the one hand to the locking element 22—as already stated—and is fixed on the other hand to the peripheral surface of the sleeve 21. As soon as the spiral spring 23 is tensioned within approximately two to three revolutions of the serving device 7, the pawl 17 with its weight 17' arrives against a stripper 20 whereupon the pawl 17 is unlatched from the recesses 21', 19' and the freed sleeve 21 together with its recess 21' is rotated back by the expansion of the spiral spring. In so doing, the recess 21' in the sleeve 21 is brought outside the recess 19' on the hub 19 so that the pawl 17 runs freely around the sleeve 21 once again.

Figure 3:
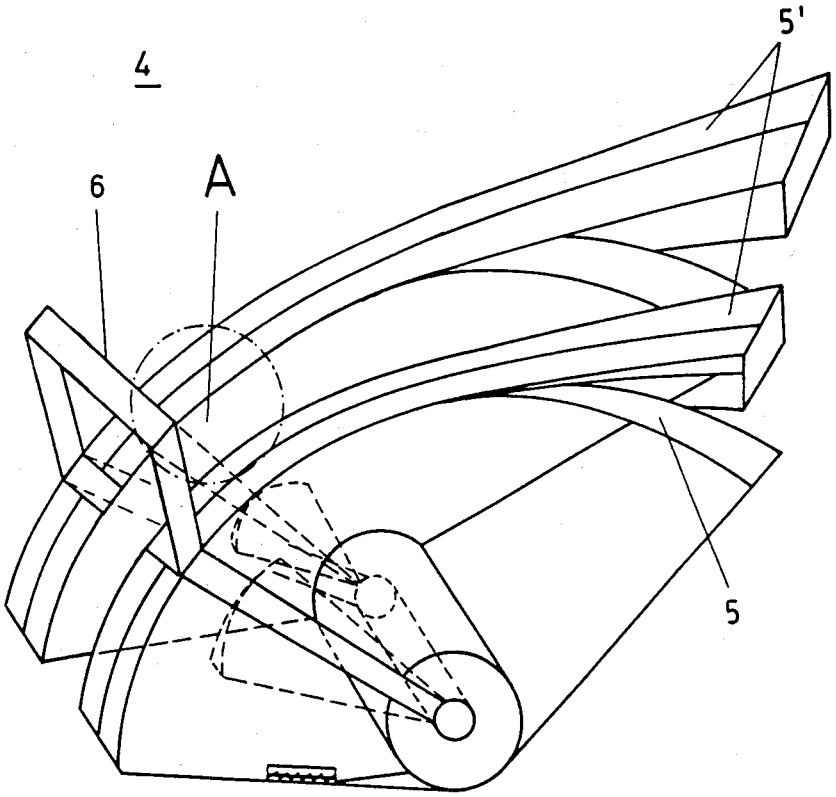
FIG. 3 is a perspective view of a supporting and guiding device of the apparatus formed by a curved guide track.

FIG. 3 shows the supporting and guiding device 4 wherein the curved guide tracks 5 bear the ball stop means 6 in the serving position A. The supply of balls takes place radially with respect to the ball stop means 6 through the guides 5' arranged outside the serving track D. The supporting and guiding device 4 is arranged coaxially with respect to the central shaft 2 wherein the curved guide tracks 5 are made adjustable in the peripheral direction for adjusting the height of the ball flight path. Any suitable means could be provided for rotating the tracks 5 relative to the frame of the ball throwing device. Rotation of the tracks 5, for example, in the counterclockwise position, moves the straight tracks 5' upwardly so as to propel the ball at an initial higher angle. The ball stop means 6 is likewise made adjustable in the peripheral direction so that an optimal setting of the serving position A is possible.

Figure 5:
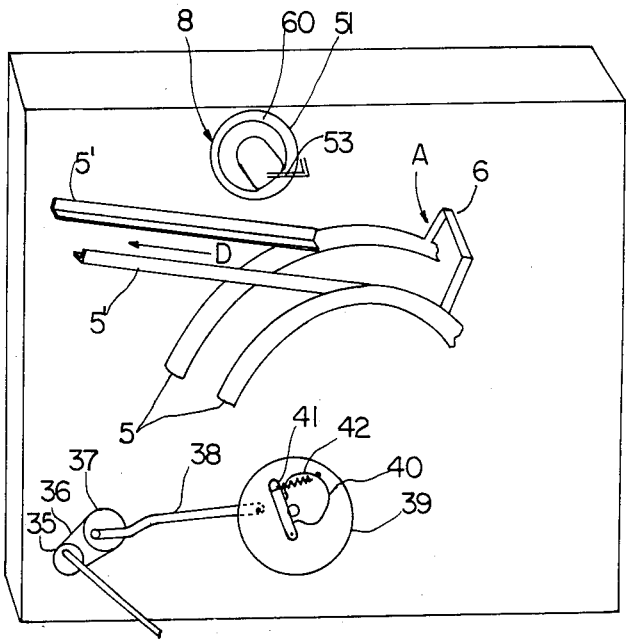
FIG. 5 is a front perspective view of the device shown in FIG. 4 and a partial view of the supporting and guiding device.

FIGS. 4 and 5 show the ball supply device 33 in which the balls from the storage container 48 (FIG. 1) arrive through a laterally pivotable charging opening 34 in the housing 47 of the ball supply device 33. The laterally pivotable charging opening 34 prevents blocking of the ball supply, for example through jamming of a ball in the charging opening 34. The pivotal movement of the charging opening 34 is produced by a pivoting device which includes a sprocket 35 driven by the driving device 1, a chain 36 and a driving wheel with an eccentric 37, a lever 38 and a safety clutch 39 operating in both senses of rotation. The safety clutch 39 is formed from a cam disc 40 arranged on a common shaft 43 and which is urged against a cam roller 41 by a spring 42. The rotary movement is converted into a reciprocating movement of the charging opening 34 by the shaft 43 in that at the end of the shaft 43 facing the charging opening 34 a plate with an opening is provided which plate pivots laterally to and fro in the charging opening 34. If, for example, the pivotal movement was blocked by jamming of a ball in the charging opening 34, the safety clutch 39 then continues to run free.

The balls in the housing 47 of the ball supply device 33 are supplied through the charging opening 34 and arrive at the driven roller 44. The rollers 44, 45 are connected to one another by a vertically circulating endless belt 46 which is arranged at a predetermined distance from the side wall 47' of the housing 47 so that the balls, which are lightly compressed beneath the roller 44 and vertically between the endless band 46 and the side wall 47', are constrained to move upwards until they arrive over the upper roller 45 in the waiting position B. From the waiting position B, the ball rolls through a supply opening 51 over the guides 5' and the guide tracks 5 up to the ball striker 6 in the serving position A, as has already been described with regard to FIG. 1. So that the following balls cannot arrive in the serving position A, the supply opening 51 and the waiting position B are blocked by a ball stop 53 see FIG. 5 wherein a ball 60 is shown being restrained by stop 53. The ball stop 53 is controlled by a magnetic element 54 actuated by the control device 3 and has a detent 55 in which the magnetic element 54 can engage. On each of its ends, the ball stop 53 has a loop so that no ball can be supplied not only in the supply opening 51 but also in the waiting position B. As long as the waiting position B is blocked the subsequent balls are conveyed to a return opening 52 and fall back into the storage container 48. After the ball, located in the serving position A, has been served the magnetic element 54 latched in the detent 55 is swung away by the control device 3 so that the ball stop 53 is pivoted away from the supply opening 51 and the waiting position B and a further ball can arrive through the free waiting position B and through the supply opening 51 into the serving position A. Shortly thereafter the ball stop 53 is swung back once again so that the following balls are returned once again into the storage container 48. Accordingly, with reference to FIGS. 1 and 4, balls from storage container 48 enter housing 47 through a charging opening 34. Behind the charging opening 34 is a plate provided with an opening. The plate pivots laterally to and fro by means of a connection to shaft 43, cam wheel 40 and reciprocating lever 38 with a connection to driven eccentric wheel 37. Balls coming through the opening 34 roll down the ramp where they are engaged by the endless belt 46 and conveyed to a waiting position B. The openings on either side of the waiting position B are blocked by an electromagnetically actuated ball stop 53. When the stop 53 is moved to allow a ball to exit through the opening adjacent the waiting position B, the wall with roll over guide tracks 5 to the position A.

Base plate 8, rotatably driven by control shaft 2, has a diameter such that the peripheral surface thereof lies beneath the guides 5' and within the curved guides 5. The serving plate 25, in its latched or inoperative position, lies within the diameter of the base plate and accordingly lies beneath guides 5' and within guides 5 during the rotating movement of the base plate. When the serving plate is unlatched and urged to its serving position by spring 31, the ball striking portion of plate 35 is pivoted to a position outside the diameter of the base plate 8 and above the guides 5', so that as base plate 8 is rotated the serving plate is in a position to strike a ball resting against stop means 6.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A sports equipment training device, particularly for propelling tennis balls, comprising a drive mechanism, a ball propelling mechanism rigidly connected to a central shaft rotatably driven by said drive mechanism, a ball feed mechanism including a loading opening communicating with a storage container, a supporting and guiding device for receiving a ball from the ball feed mechanism, a control means for setting the angles of propulsion in the altitude and azimuth directions of the ball, said ball propelling mechanism including a propelling plate which can be swung into a propulsion pathway to strike said ball, and a transmitting means for resetting said propelling plate subsequent to striking said ball, said transmitting means including a detent, a freewheel coupling rotationally rigidly connected to a hub, said hub provided with a recess, said propelling mechanism disposed on a common base plate rotatably driven by the drive mechanism; a supporting and guiding device including curved guide paths located on both sides of the base plate above an end face of the base plate; wherein the ball feed mechanism further includes roller means and an endless belt in engagement with said roller means for feeding the balls; and means provided for reciprocating the loading opening from side to side.

2. A training device according to claim 1, wherein the freewheel coupling includes a sleeve rotatably mounted coaxially to said hub, and the hub and the sleeve each include recesses, and wherein these recesses are movable to a coinciding position to allow said sleeve to engage the recesses to provide a rotational coupling between said hub and said sleeve.

3. A training device according to claim 2, and further including adjusting plate which is pivotably mounted on an axis and the supporting and guide mechanism, the drive mechanism, the ball propelling mechanism and the control means are disposed on said adjusting plate.

4. A training device according to claim 1, wherein the supporting and guide mechanism further includes guides having an exit zone which is straight, and a ball striker, said ball striker and said curved guide paths are adjustable in the circumferential direction.

5. A training device according to claim 4, and further including adjusting plate which is pivotably mounted on an axis and the supporting and guide mechanism, the drive mechanism, the ball propelling mechanism and the control means are disposed on said adjusting plate.

6. A training device according to claim 1, and further including adjusting plate which is pivotably mounted on an axis and the supporting and guide mechanism, the device mechanism, the ball propelling mechanism and the control means are disposed on said adjusting plate.

* * * * *